United States Patent [19]

Quigley

[11] 3,951,374

[45] Apr. 20, 1976

[54] BOOK HOLDER

[76] Inventor: Wanda L. Quigley, 1950 Connell Road, Ortonville, Mich. 48462

[22] Filed: Sept. 16, 1974

[21] Appl. No.: 506,114

[52] U.S. Cl. ..... 248/451; 248/444

[51] Int. Cl.[2] ..... A47B 97/04

[58] Field of Search ..... D6/138, 184; 108/43; 248/441 R, 444, 445, 451, 452, 453; 297/DIG. 1; 312/233

[56] References Cited

UNITED STATES PATENTS

| | | | |
|---|---|---|---|
| 289,652 | 12/1883 | Haynes | 248/451 |
| 1,263,761 | 4/1918 | Haslam | 248/453 |
| 1,376,212 | 4/1921 | Mayhew | 248/451 |
| 1,864,807 | 6/1932 | Dahlgren | 248/453 |
| 2,478,849 | 8/1949 | Thompson | 248/444 |
| 3,476,497 | 11/1969 | Cashen et al. | 297/DIG. 1 |
| 3,599,925 | 8/1971 | Dubler | 248/452 |
| D168,420 | 12/1952 | Pinkham | D6/184 |

FOREIGN PATENTS OR APPLICATIONS

| | | | |
|---|---|---|---|
| 768 | 1/1886 | United Kingdom | 248/451 |
| 177,540 | 7/1953 | Austria | 248/454 |
| 681,993 | 5/1930 | France | 248/445 |

*Primary Examiner*—Roy D. Frazier
*Assistant Examiner*—Lawrence J. Staab
*Attorney, Agent, or Firm*—Harness, Dickey & Pierce

[57] ABSTRACT

The book holder is made of a foamable plastic material which when placed in a mold and foamed will form a durable skin over the area contacted by the interior mold surface. The holder has a front upright face against which the cover of the book is secured by elastomeric strips of inverted V-form, the inner strip of small angle secures the cover of a paper-backed book to the holder face while the next strip of inverted V-shape of greater angle supports the back covers of a hard-back book against the face. An additional strip in inverted V-form of elastomeric material may be used for supporting the pages of the book when the book holder is swung to the right side or the left side from a vertical position so that one reading the book may do so when resting on one or the other side while reading in prone position.

8 Claims, 3 Drawing Figures

BOOK HOLDER

BACKGROUND OF THE INVENTION

Book holders usually embody a platform having two sets of legs which are hinged near the ends to swing downwardly and straddle a reclining person's stomach with a hinged portion at the front which may be raised upwardly and on which the book is supported. This type of structure was found to be somewhat awkward, quite expensive and is limited to a use as the legs required a support when disposed in substantially vertical position.

SUMMARY OF THE INVENTION

The invention pertains to a book holder which is made from a foamable plastic material in a mold within which a tough flexible skin is formed on the outer surface. The holder has an upright section with a face which slopes rearwardly and outwardly at the edges from the center forming a surface against which the cover of the book is held by elastomeric cords or strips. The cords or strips are disposed in inverted V-form with the ends extending through the bottom and secured by paper clips or similar securing elements therebelow. The central part of the cord or strip extends through an aperture at the top center of the holder and is preferably retained in position by a bead through which one or more of the cords are threaded and retained in position thereby. The first cord has a slight angle of approximately 10° under which the paperback cover of a paperback book is extended so that the book will be held in fixed relation to the holder back. The next cord or strip is disposed as an inverted V of greater angularity of approximately 20° under which the hard cover of a standard book is inserted and retained against the holder back. A third cord or strip of inverted V-shape disposed at an angle of approximately 45° is used for retaining the pages at one side of the book against the cover to permit the holder to be tilted onto its side and have the pages retained against falling against the lower pages and cover. The sides of the holder converge downwardly and rearwardly and the upright back is recessed to substantially reduce the amount of material required to mold the holder. A shelf is provided forwardly of the upright back having a slot into which the bottom of the hard cover extends. The shelf engages the bottom of the pages and retains them in position adjacent the cover. A flange extending upwardly forwardly of the shelf over which the pages must pass when turned to provide further assurance that in normal operation the pages will be held in position prior to and after being moved from the righthand side to the lefthand side of the book. While such movement may be done by hand, an instrument could be employed which has an antifriction element on the projecting end by which a page may be engaged and turned from the right to the lefthand side. The material on the end of the instrument may be a rough foamed material or may be wirelike projections which will engage a glazed page without slipping when turning a page.

DESCRIPTION OF THE PREFERRED EMBODIMENT

Figure 3:
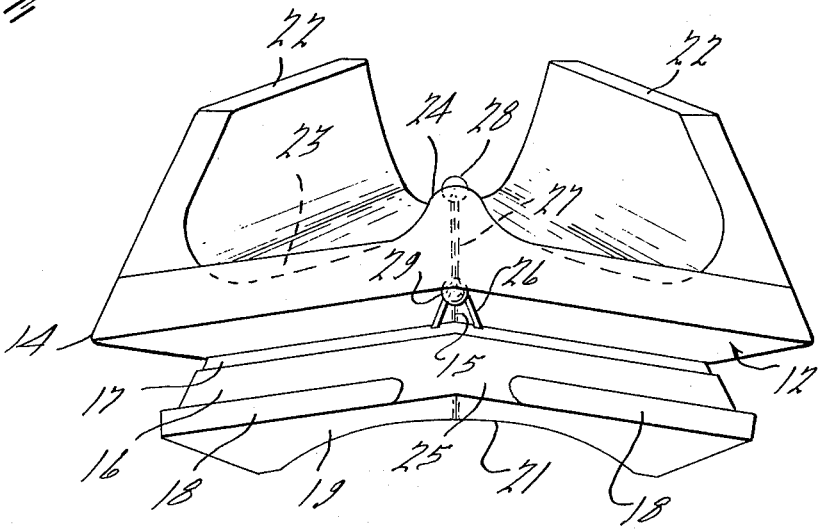
FIG. 3 is a top plan view of the structure illustrated in FIG. 1.

The book holder 11 of the present invention comprises a unit element 12 which is molded from a foamable material, one which produces a tough skin over the entire outer surface of the holder. A polyurethane self-skinning foam reaction material could be used as well as a polyvinyl or polyvinyl copolymer foam reaction mixture and probably others which are known in the art to be suitable. The unit element 12 has upstanding wall sections 13 and 14 which slope rearwardly and are disposed in angular relation to each other from a central line 15 at approximately 150°. A shelf 16 extends forwardly of the wall sections 13 and 14 and provides a narrow channel 17 thereagainst in which the projecting bottom edge of a hard cover of a book extends. Forwardly of the shelf 16, upwardly extending flanges 18 are provided for preventing the return of a page after being turned and disposed over the adjacent flange. The flanges 18 are disposed at the top of the bottom forwardly extending portion 19 which has a rearwardly converging arcuate recess 21 at the bottom. Sides 22 likewise converge toward the rear, as clearly illustrated in FIG. 3, where they are shown as being of predetermined thickness leaving the area therebetween recessed as noted at 23 with the center provided with a ridge 24. A notch 25 between the flanges 18 permits the passage of a page from the righthand side to the lefthand side of the book.

For retaining the book fixed to the upstanding wall sections 13 and 14 elastomeric cords or strips 26 may be employed having the center extending through an aperture 27 at the top center and through a pair of holes in a bead 28 with a bead 29 slidable over the two extending branches of the strip. The ends of the branches of the strip are passed through apertures 31 at the inner portion of the shelf 16 and is knotted at the end and secured by a paper clip or similar element 32 held against the surface of the arcuate recess 21. A second elastomeric strip 33 is employed along the centerline 15 between the wall sections 13 and 14 of the upright portion 12 of the unit element having the central portion likewise pass through the aperture 27 and the two holes in the bead 28 and through the opening in the bead 29. The ends of the branches of the strips pass through two additional apertures 31 which are closely spaced and provide an inverted angle of approximately 10°. The strip 33 is used to support a paperback book against the upstanding wall sections 13 and 14 and provides a holding force directly adjacent to the pages of the book. It will therefore be noted that either of the strips 26 or 33 is useable for supporting a book with a hard cover or a book with a paper cover in readable positions on the holder.

Figure 1:
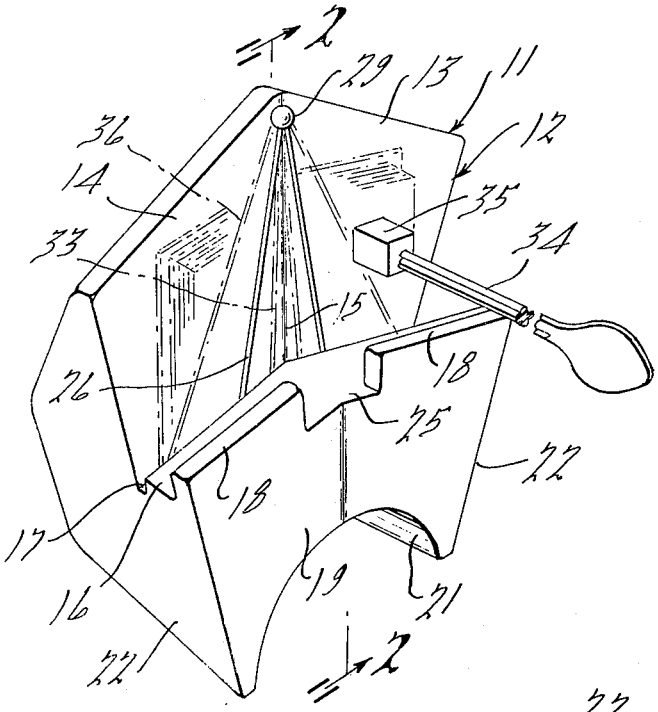
FIG. 1 is a view in perspective of a book holder embodying features of the present invention.
Figure 2:
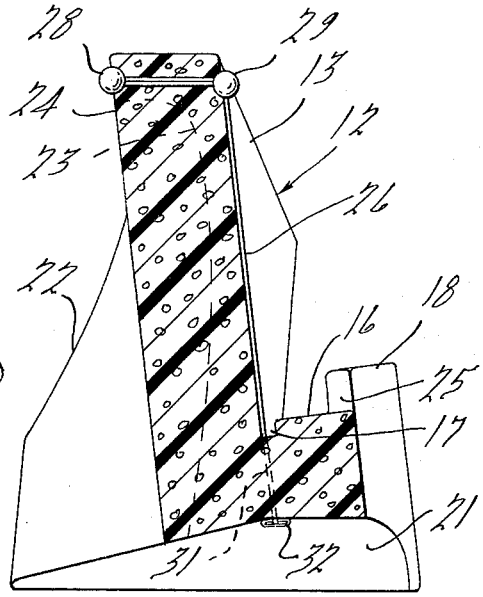
FIG. 2 is an enlarged sectional view of the structure illustrated in FIG. 1, taken on the line 2—2 thereof.

As illustrated in FIG. 1, an instrument 34 may be used for turning the pages from right to left. The instrument 34 has a friction element 35 on the end which may pierce the surface of the paper if glazed or frictionally engage the paper to move the page over the flange 18 beyond the recess 25 and over the aligned flange 18. The page will remain in turned position as it will engage the top of the shelf and be located behind the flange 18. The remaining pages will likewise be retained against turning by the friction on the bottom of the pages and their position beyond the flanges 18.

It will be noted that the unit element 12 may rest upon the stomach, thigh or other portion of the body depending on whether the reader is sitting, reclining or lying down. The unit element 12 may be placed on either of its sides 22 so that when lying in bed one may continue to read when lying on either the right or left side. In this case, it is desirable that a third cord or strip 36 be employed having its center extending through the aperture 27 and the spaced apertures of the bead 28 with its branches extending through apertures at the inner edge of the shelf outwardly of the apertures 31 to be in line therewith and retained in the same manner as the strips 26 and 33 and have their bottom knotted edges supported on the surface of the arcuate recess 21. With this arrangement, the pages at either side of the book may be placed under either branch of the strip 36 so as to prevent them from falling downwardly when the unit element 12 is placed on one of its sides. A single page may be moved from beneath the branch of the cord or strip 36 and moved down against a bottom page so that the reading can continue from one page to another in the normal manner when lying on one's side. The printing usually terminates a sufficient distance above the bottom of a page so that the flanges 18 will not obstruct any of the printed matter and keep it from being read. It is to be understood that other types of holding means besides the cords or strips 26, 33 and 36 could be used to hold the covers and pages in the manner pointed out above.

I claim:

1. In a book holder, a unit element molded from a foamable plastic material to have a soft interior and a durable outer skin, said unit element having a pair of upright wall sections converging toward the center, an outwardly projecting shelf near the bottom of said sections, and flat side wall portions extending rearwardly from the side edges of said sections and converging rearwardly and downwardly to provide a recessed area behind said sections.

2. In a book holder as recited in claim 1, wherein two branches of an elastomeric cord are disposed in inverted V-relation, and an apertured ball provided at the apex of the V for abutting the rear surface of the sections near the top thereof with the two branches passing through an aperture thereat and stretched apart and secured to the bottom of the holder for supporting a book against said sections.

3. In a book holder as recited in claim 1, wherein the converging sides on said unit element are capable of being supported on either side at substantially right angle from an upright position to permit the reading of the book in the holder when lying on one's side in a bed.

4. In a book holder as recited in claim 1, wherein a pair of spaced upwardly extending flanges are provided along the forward edge of said shelf to retain the pages from turning and having the space at the center thereof to permit the leaves of the book to pass thereacross when turned.

5. In a book holder as recited in claim 1, wherein a recess is provided at the bottom of the unit element which converges toward the rear.

6. In a book holder as recited in claim 2, wherein a second apertured ball is provided on the cord on the opposite front face at the center of the sections to prevent the cord from cutting the material of the book holder.

7. In a book holder as recited in claim 3, wherein a second cord of elastomeric material is anchored at the top of the wall section with the ends of the two branches secured to the bottom portion of the unit to retain the leaves from turning when the holder rests on a converging side.

8. In a book holder as recited in claim 1, wherein a page turning instrument has an end portion which provides friction engagement with the surface of a page for turning the page from one side to the other side of the book.

* * * * *